United States Patent [19]

Landstrom et al.

[11] 4,333,402

[45] Jun. 8, 1982

[54] ARRANGEMENT FOR LAUNCHING INTERFERENCE MATERIAL

[76] Inventors: Sven Landstrom, Fjallgatan 16, S116 45 Stockholm; Kaj Lundahl, David Bagares gatan 26A, S-111-38 Stockholm, both of Sweden

[21] Appl. No.: 189,832

[22] PCT Filed: Feb. 22, 1979

[86] PCT No.: PCT/SE79/00039

§ 371 Date: Oct. 23, 1979

§ 102(e) Date: Oct. 23, 1979

[87] PCT Pub. No.: WO79/00658

PCT Pub. Date: Sep. 6, 1979

[51] Int. Cl.[3] ..... F42B 13/42

[52] U.S. Cl. ..... 102/505; 102/340; 102/351; 102/357; 343/18 E

[58] Field of Search ..... 102/501, 505, 357, 340, 102/351, 221, 222, 278; 343/18 E, 18 B

[56] References Cited

U.S. PATENT DOCUMENTS

| | | | |
|---|---|---|---|
| 3,899,975 | 8/1975 | Laurence | 102/505 |
| 4,026,188 | 5/1977 | Woodruff et al. | 89/1.5 R |
| 4,031,828 | 6/1977 | Larson | 102/505 |
| 4,175,469 | 11/1979 | Ritland et al. | 102/505 |
| 4,222,306 | 9/1980 | Maury | 102/505 |
| 4,263,835 | 4/1981 | Dragonuk | 89/1.5 |

FOREIGN PATENT DOCUMENTS

| | | |
|---|---|---|
| 2638920 | 2/1978 | Fed. Rep. of Germany . |
| 382040 | 2/1976 | Sweden . |
| 1248867 | 10/1971 | United Kingdom . |

OTHER PUBLICATIONS

English translation of German patent app. OS 2530 057.
English translation of Swedish published patent application 76-01-570-0.
British Counterpart of German published patent application OS 1,961,642.

*Primary Examiner*—Harold Tudor
*Attorney, Agent, or Firm*—James R. Custin; James E. Nilles

[57] ABSTRACT

A projectile (1) containing particles of interference material is fired pneumatically from a launching tube (2). Compressed air, which is supplied to the launching tube and acts on the rear face of the projectile during firing, is conducted both to a loading chamber (19) wherein the air pressure is maintained even after the projectile has left the firing tube, and also via the loading chamber to an expansion chamber (20) in which, after a specific time-lag corresponding with a certain launch height on the trajectory of the projectile, an over-pressure builds up which causes the expansion of the chamber to be initiated with simultaneous expulsion of the interference material from the projectile. The compressed air may also be conducted to the chamber (10) in the projectile wherein the interference material is accommodated, tightly packed, in order to enhance the dispersion thereof.

5 Claims, 4 Drawing Figures

ARRANGEMENT FOR LAUNCHING INTERFERENCE MATERIAL

The present invention relates to an arrangement for launching particles of interference material for defensive purposes. The interference material can consist of a metal or metal-coated material in the form of a multiplicity of thin strips or fibres, knows as dipoles, which, with a view to leading astray hostile guided missiles equipped with radar homing devices during an attack on a particular target, can be dispersed rapidly from this target into a nearby area in space. For effective confusion of the guided missiles it is necessary for the interference material to be dispersed at the correct moment to form a cloud positoned in a specific way, within which the radar-reflecting material is distributed as evenly as possible, and for the cloud to provide a target area which is larger than the actual objective, so that the latter will not be hit after elusive manoeuving. Another interference material which may be used is powdered carbon which, if sufficiently distributed in a similar manner, can form a cloud which is capable of absorbing heat radiated from the actual objective so that the latter escapes detection by an IR homing device. An important field of application for the invention lies in the use of this type of firing arrangement on ships. As is known, the environment on the open sea requires that all equipment on board a marine vessel must fulfil special requirements with regard to reliability, durability and simplicity of handling, and conventional systems for firing interference materials based on pyrotechnic firing means with electrical ignition devices have difficulty in fulfilling these requirements. Safety regulations exist which forbid the reloading of such launchers at sea.

For marine use, there is also a requirement that the interference cloud should not be formed immediately after the projectile is fired, but only after a certain time has elapsed corresponding with a predetermined trajectory height or distance from the actual objective, as this greatly increases the defensive protection which is provided by the interference material. For the same purpose, in pyrotechnically operated firing devices intended for use on aircraft, provision is made for a timing device to be installed in the projectile which controls the release of the interference material from the projectile case. In addition to the fact that providing such a time-lag makes the projectile considerably more expensive and complicated, there is also a reduction in its reliability and resistance to ageing.

The knowledge of these defects in pyrotechnically operated interference material launchers, combined with the fact that whenever this type of equipment is installed on board marine vessels there is access to compressed air, has led to a construction concept in which all of the firing process is pneumatic. The present invention is therefore based on a launcher which comprises at least one substantially upwards-pointing firing tube in the lower part of which there is a connection for the supply of compressed air to the tube, and an elongated projectile which can be inserted in the tube and the casing of which forms a chamber in which the interference material is accommodated, this projectile being designed to be fired through the upper end of the launching tube by means of compressed air which is supplied through the said connection, the interference material being released from the projectile at a specific time after the latter has been fired, and spreading out so that it forms a cloud of interference at a specific distance or at a specific height.

Such an arrangement is know from DE-OS No. 25 27 206. The launching tube in this instance forms a single hollow chamber in the upper part of which interference material is accommodated in a pair of containers located one behind the other. The tube is loaded in advance with compressed air which also spreads into the interference material containers, and to prevent the air from flowing out of the tube the upper end is closed off with a lid around which there is an explosive charge. Launching takes place by setting off this explosive charge in a way not described in detail, so that the lid is removed and the interference material containers are launched like projectiles by the compressed air rushing out of the tube.

To disperse the interference material each container is equipped with a pyrotechnic delay device which is supposed to be actuated on firing by means of an electrical ignition circuit comprising electrodes in the ends of the containers.

In the known arrangement, therefore, compressed air is used as the effective medium only for the actual launching process, while the other important phase of the process is carried out pyrotechnically and calls for faultlessly operating electrical ignition means. The arrangement does not therefore provide a satisfactory solution to the problem of how to make a launching arrangement for interference material projectiles which is simple, robust and reliable in the marine environment as well, and in which both the launching of the projectile and the subsequent dispersion of the interference material are effected by pneumatic energy.

This problem is solved according to the primary characteristics of the present invention in that the projectile has a first pressure chamber which is arranged to be loaded with the air pressure which prevails at the moment of firing in the lower part of the launching tube behind the projectile, a second pressure chamber located between the first pressure chamber and the interference material compartment and separated from the latter by a piston component which is locked relative to the casing of the projectile at the moment of firing, but which is arranged so that, for expelling the interference material with a longitudinal movement into the said compartment, it is released when a pre-determined pressure arises in the second pressure chamber, and means for allowing compressed air to pass from the first pressure chamber to the second pressure chamber with a controlled flow such that the flow of compressed air is initially small, with a result that the pre-set pressure does not occur before the projectile has left the launching tube and the said time-lag has elapsed, but thereafter the flow is greatly increased so that the piston component now released can be endowed with a rapid expelling movement by the compressed air with which the first chamber is loaded.

Since the compressed air which operates the actual launching tube is also used here for the time-controlled separation of the projectile casing and the interference material, the requirement is met for an appliance which operates completely independently of pyrotechnical and electrical means and which also fulfils the other requirements. The solution described according to the invention also eliminates the risk of accidents associated with such means, during handling and storage.

According to another characteristic of the invention, the compressed air can also assist the dispersion of the contents of the projectile; this important phase formerly caused considerable problems, especially when the contents consisted of dipoles. Even if, as is know from U.S. Pat. No. 3,095,814, the dipoles are packed in bundles which are stacked longitudinally one behind the other on the casing of the projectile and are separated by transverse partitions, the dipoles will tend to behave as lumps or wads in the air, which is obviously not as efffective from the point of view of interference as a cloud formation with evenly distributed dipoles, spaced out from one another. According to the said American Patent specification, the contents are expelled from their case with the aid of a spring after which the entire contents is intended to be dispersed in the lateral direction at one and the same time by jets of gas which act momentarily and are directed to points in the central part of the contents via a perforated tube which obtains its pressure from a small, punctured bottle of compressed gas. Instead of this complicated and functionally unreliable dispersing arrangement, the present invention offers a solution which is extremely simple and provides improved separation since the said first pressure chamber communicates with the compartment for the interference material via a duct with a restricted cross-section so that an over-pressure produced in the first chamber occurs in the compartment at the end of the time-lag, and enhances the dispersion of the interference material.

Due to the over-pressure prevailing in the compartment, which is built up continuously during the entire launching process and is thus able to spread out in both the axial and the radial direction throughout the entire load, which in this construction can be bundled and encased in thin, slit foil cases. In conjunction with the successive expulsion and exposure to the environment, there is continuous emptying with separation in the radial direction enforced pneumatically, progressing bundle by bundle as the projectile continues further along its trajectory.

Other features appertaining to the launching arrangement will become apparent from reading the following description in which the invention is explained in more detail with reference to the attached drawing, which shows two construction forms of the arrangement.

Figure 1:
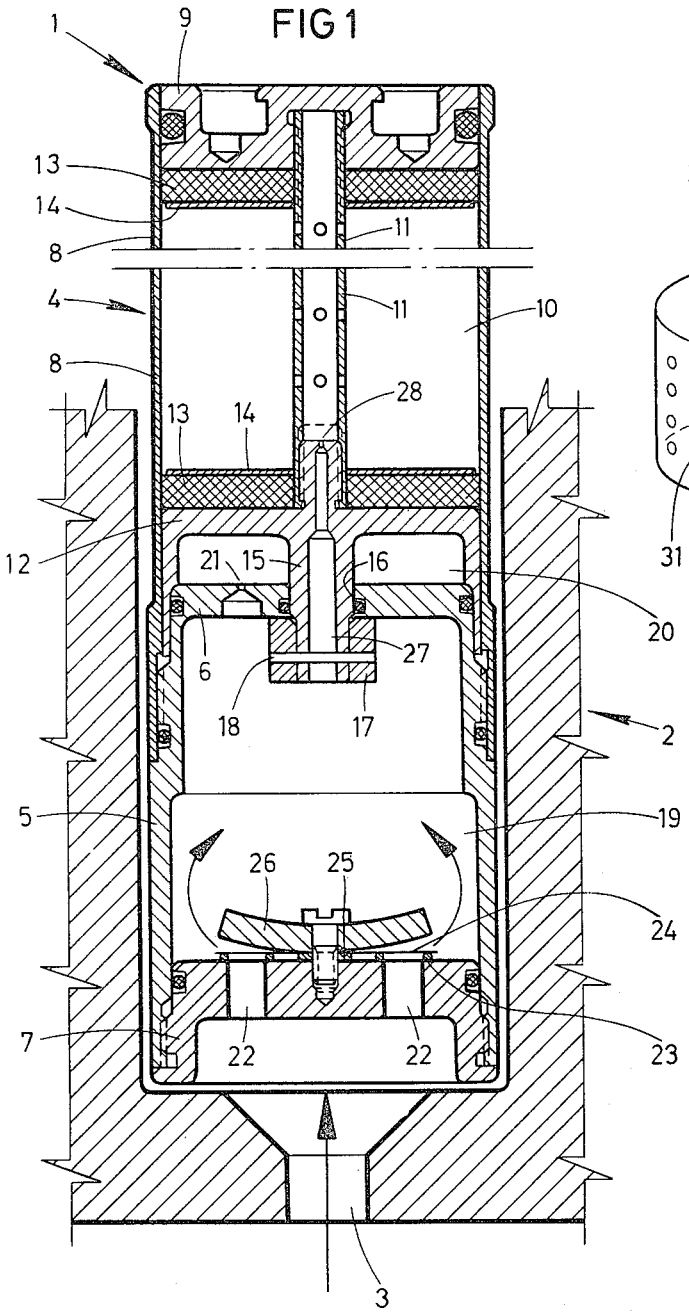
FIG. 1 shows a launching arrangement according to the invention, in longitudinal section.

In the drawing, 1 designates generally an elongated, substantially cylindrical container or projectile which may contain a radar-reflecting interference material in the form of thin aluminium strips or fibres made of glass and coated with aluminium, and which is therefore called the strip projectile in the following.

When the strip projectile is to be used, it is inserted in a launching tube 2 which forms a substantially upright cylindrical hollow chamber, in the lower part of which there is a connection 3 to which compressed air or similar highly compressed gas is conducted from a pressure source. The supply of compressed air should be such that when launching is to be carried out the initially pressurefree launching tube is set instantaneously under full pressure.

The casing 4 of the strip projectile, which is advantageously made of aluminium or other lightweight material, is made up in the example shown in FIG. 1 from a rear shell-shaped part 5, which is defined at the front by a transverse partition 6 while the back part has an end wall 7, and a front tubular part 8 which is screwed firmly onto the rear part and is shown in the Figures with its length greatly foreshortened. At the extreme front the projectile has a lid 9 tightly fitting in the casing part 8, this lid defining a compartment 10 for the charge of strips and having a perforated tube 11 extending from its centre longitudinally through the said compartment and attached at its other end to a piston means 12. As the Figure shows, on the upper face of this piston and also underneath the lid 9, packing rings 13 made of soft material may be provided, together with their covering washers 14, for adapting the length of the compartment 10 to the actual load.

The piston means 12 is equipped on its rear face with a projection 15 which fits tightly in a passage 16 in the partition 6, on the rear face of which the projection is locked from moving forwards by means of a casing 17 and a shear pin 18 which extends transversely through the casing and the projection. The pin should be calibrated for a specific maximum shearing load which in this instance is provided by an axially upwardly directed force from the piston means, at which shearing load the piston means is accordingly released for upward movement through the compartment 10.

At the very beginning of the piston movement, the projection 15 is withdrawn from the passage 16, opening the passage so that it provides substantially unrestricted communication between the rear hollow chamber 19 in the projectile—which is called the first pressure chamber in the following—and the chamber 20 defined by the partition 6 and the piston 12—called the second pressure chamber. In addition to the connection thus established via the passage 16, the two pressure chambers are in constant communication with each other via a throttle aperture 21, the through-flow area of which should be adjusted precisely and should be small in relation to the area of the passage 16.

For the admission of compressed air to the strip projectile, its rear end wall 7 has a number of openings 22 arranged in a circle around the centre point of the wall, on the inner face of which there are valve seats 23 coacting with a flat flexible valve plate 24. This is attached at the centre point of the wall between a spacer 25 and a backing plate 26 and controls the flow in a conventional way like a non-return valve so that, when there is a pressure difference, the flow takes place via the openings 22 into the chamber 19 but not out of it.

Finally, in the construction form according to FIG. 1 there is a longitudinally extending duct 27 which is located in the centre of the piston means 12 and terminates in a hole 28 which opens out in the central tube 11 and the cross-section of which should be considerably less than the cross-section of the throttle aperture 21. In this way the first chamber 19 is in pressure-transmitting communication with the compartment 10 and the load of strips accommodated therein, but the pressure is built up considerably more slowly than in the second chamber 20.

Figure 2:
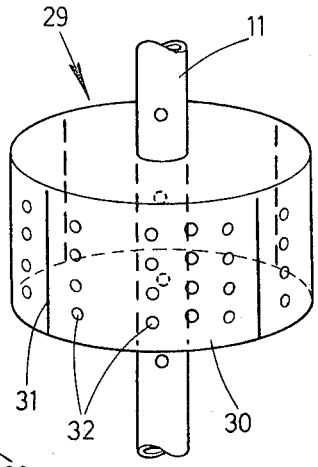
FIG. 2 is a perspective view of a bundle of strips enclosed in a casing and part of a central tube appertaining to a strip projectile.

An example of how the load can be arranged is shown in FIG. 2. Threaded on the central perforated tube 11 there is a number of packets of strips 29, of which only one is shown in the figure and which together fill the loading compartment 10. Each packet which contains in a known way a multiplicity of axially arranged, tightly-packed parallel dipoles of a specific length is encased in thin foil comprising a casing 30 that conforms with the inside of the front part 8 of the projectile housing and is preferably provided with a number of longitudinally extending slits 31 to increase the tendency of the casing to split when the strips are released. In the foil there can also be rows of holes 32 for communicating in the radial direction with the peripheral part of the loading compartment.

Figure 3:
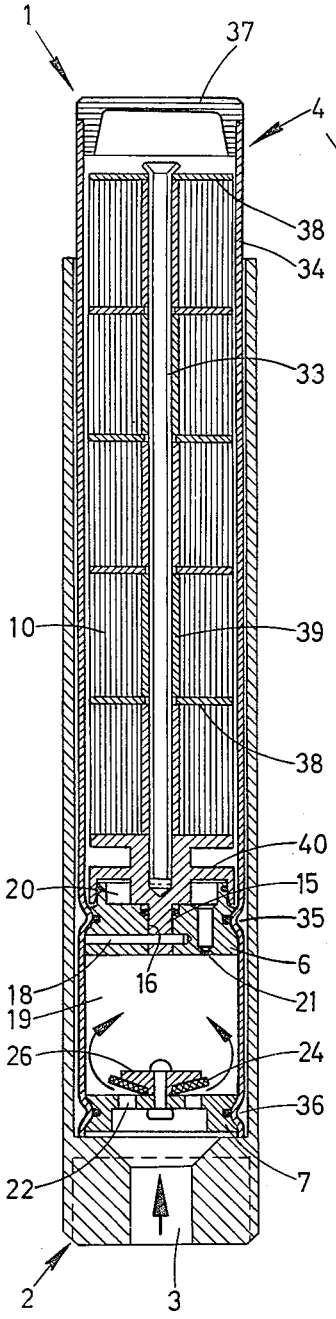
FIG. 3 is a longitudinal section of an alternative version of the launching arrangement in which the projectile is shown in position before launching.
Figure 4:
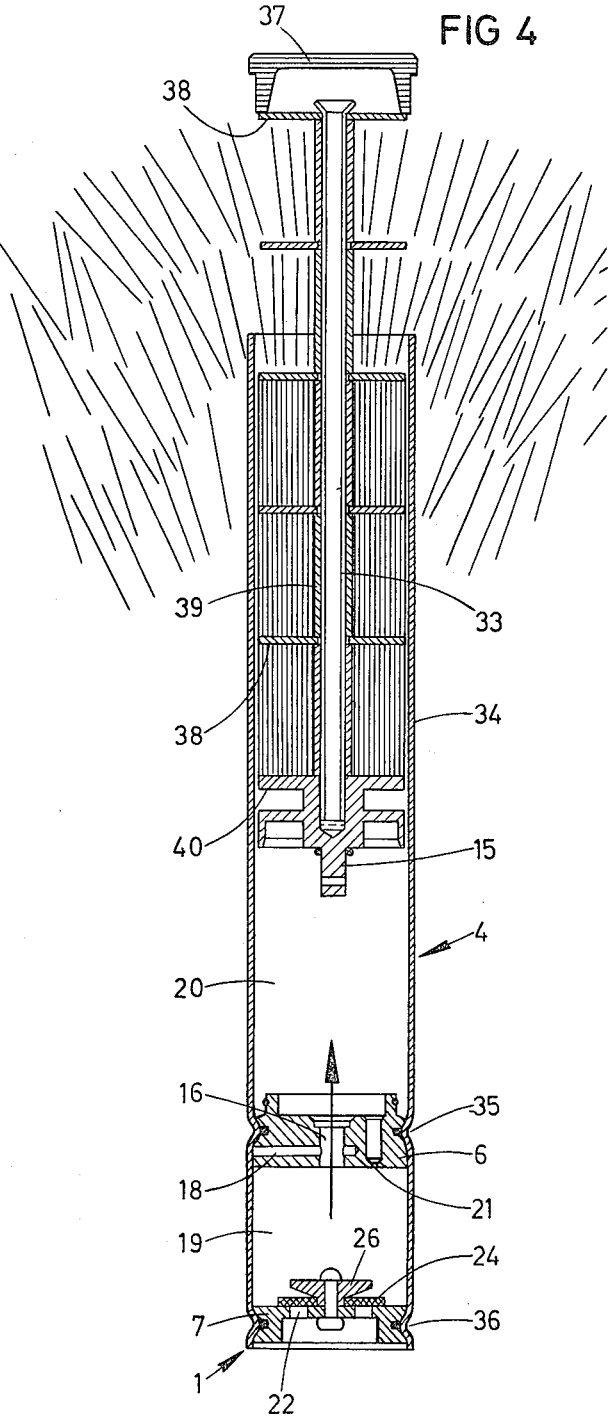
FIG. 4 shows, also in longitudinal section, the projectile of FIG. 3 after firing and during the beginning of the dispersion of the interference material.

In the version shown in FIGS. 3 and 4 in which the same reference numerals are used for parts which are the same as those previously described, there is no pressure transmitting connection to the loading compartment 10; the central tube 33 is not perforated and serves only as a central support column for the load of strips. In this instance, the casing 4 of the projectile is constructed of a single tube 34 which is joined to the partition 6 and the end wall 7, for example, in that at the points 35 and 36 grooves are machined into the walls, O-rings are inserted into the grooves, and the tube material is pressure-rolled into the grooves. The front end of the tube is closed off by a bottle-cap type of lid 37 which is easily removed by a blow from a plate 38 attached to the top of the tube 33 when the expulsion process begins.

Several such transverse plates are threaded on the central tube and between each pair of plates there is a spacer tube 39 which expediently divides up the loading compartment axially into sections, each of which is adapted for one packet of strips, this spacer tube consequently preventing the load of strips from being compressed against the piston component 40 during launching. As the drawing shows, the latter has a certain amount of play relative to the inside of the casing 4 of the projectile so that the piston means will slide easily and air can be forced up from below past the piston component, acting as a lubricating medium for it and for the packets of strips.

The operating sequence or launching process will now be described, using the reference numerals given in FIGS. 3 and 4. As soon as compressed air enters the launching tube via connection 3, the valve plate 24 opens so that rapidly increasing pressure is also obtained in the first chamber 19 of the projectile, at the same time that the projectile moves upwards with accelerated speed.

The pressure in the chamber 19 propagates relatively slowly to the second chamber 20 through the throttle aperture 21 which is so dimensioned relative to the volume and area of the last-named chamber and to the breaking load of the shear pin 18 that the resulting upward-directed force, which as a result of the increasing pressure after the throttle point acts on the piston 40, is equal after a predetermined time to the said breaking load. This time-lag is selected so that it corresponds with a required launching trajectory height or a required distance from the launching point. The time-lag can be adapted to the tactical conditions, but must be of such duration that the projectile will have passed out of the mouth of the launching tube and have travelled a good way further along its trajectory. In this last period the valve 24 is closed and the projectile uses only the amount of compressed air which has accumulated in the casing.

When the pin 18 shears and the piston is thereby released from the partition 6 the piston first begins to move forwards slowly into the interference material compartment 10, due to the throttled flow of air, thereby pushing the tube 33 with the plates 38 and the packets of strips located between them forwards. After the lid 37 at the front end of the projectile is removed and the piston has moved some way farther, the projection 15 is released from the partition 6, so that compressed air can thereafter flow upwards through the passage 16 as well. The effective through-flow area thus becomes considerably larger, so that the load of strips is shot forwards in a rapid expelling movement.

As FIG. 4 shows, the packets of strips split apart after they leave the projectile tube and are exposed to the air flow, with the result that the strips spread out laterally and upwards in a long stream behind the projectile which is rushing upwards. When the whole load has been released the interference material spreads out further to form a cloud with even distribution.

With the form of construction shown in FIGS. 1 and 2 launching is carried out in the same way, but with the difference that compressed air is conducted via the ducts 27 and the central tube 11, throughout the whole process, from the pressure chamber 19 to the load compartment 10. The pressure in this compartment increases so slowly due to the small area of the cross-section 28 that it does not significantly counteract the release of the piston from the casing of the projectile, but it does, on the other hand, enhance the spreading out of the strips at the moment when the load begins to be pushed out of the casing of the projectile.

The invention is not restricted to the two embodiments shown here, but can be modified in many other ways within the scope of the claims. Accordingly, the interference material can be expelled in the opposite direction to the launching direction so that the first and the second pressure chambers are arranged in the front end of the projectile in the said order. The driving medium which enters the launching tube is conducted in this version from the rear end of the projectile via a duct passing from there longitudinally through the load compartment and opening out in the first chamber.

We claim:

1. A projectile that carries a store of radiation interference medium for dispersive discharge at a predetermined time following expulsion of the projectile from a substantially tubular launcher under the force of pressure gas acting upon a rear end of the projectile, said projectile being characterized by:

A. an elongated casing having front and rear end walls, (1) said rear end wall having a port therein through which pressure gas can enter the interior of the casing during expulsion of the projectile from a launcher, and (2) one of said end walls being separable from the remainder of the casing in an endwise outward direction;

B. a piston slidable in said direction in the interior of the casing and cooperating with said one end wall to define a compartment in the casing wherein said medium is stored;

C. rigid means providing a connection between said piston and said one end wall whereby the latter is constrained to move in said direction in unison with the piston;

D. a partition fixed in the interior of said casing, between said piston and the other of said end walls, said partition (1) cooperating with said other end wall to define a first chamber of substantially fixed volume and (2) cooperating with said piston to define an expandable second chamber, and (3) having a restricted passage therethrough that provides for retarded flow of pressure gas from said first chamber to said second chamber;

E. means comprising a check valve providing for substantially unrestricted flow of pressure gas from said port to said first chamber but preventing flow of pressure gas from said first chamber through said port; and F. means providing a disruptable connection between a part fixed in the casing and another part that is fixed to the piston, said disruptable connection confining the piston against motion relative to the casing in said direction until the piston is released by force upon it in excess of a predetermined value, exerted by pressure gas in said second chamber.

2. The projectile of claim 1 in combination with a tubular launcher having an open front end through which the projectile can be expelled and a substantially closed rear end in which there is an inlet for pressure gas by which the projectile is propelled out of the launcher.

3. The projectile of claim 1 further characterized by:

(1) said partition further having a substantially large hole therethrough, to provide for substantially unrestricted communication between said first and second chambers, and (2) said piston having a projection thereon that is received in said large hole until the piston is released, to thus provide for an abrupt increase of the force upon the piston after its initial movement in said direction.

4. The projectile of claim 3, further characterized by: said means providing a disruptable connection comprising (3) a frangible pin extening transversely to said direction and connected between said projection and said partition.

5. The projectile of claim 3, further characterized by:

(3) said rigid means providing a connection between the piston and said one end wall comprising a tube extending coaxially through said compartment and having outlets therein that open radially to said compartment; and (4) there being a more restricted other passage through said projection and said piston through which pressure gas can controlledly flow from said first chamber into said tube.

* * * * *

UNITED STATES PATENT AND TRADEMARK OFFICE

CERTIFICATE OF CORRECTION

PATENT NO. : 4,333,402

DATED : June 8, 1982

INVENTOR(S) : Sven Landstrom et al.

It is certified that error appears in the above—identified patent and that said Letters Patent is hereby corrected as shown below:

The title page should be deleted to appear as per attached title page.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*

United States Patent [19]

Landstrom et al.

[11] 4,333,402

[45] Jun. 8, 1982

[54] ARRANGEMENT FOR LAUNCHING INTERFERENCE MATERIAL

[76] Inventors: Sven Landstrom, Fjallgatan 16, S116 45 Stockholm; Kaj Lundahl, David Bagares gatan 26A, S-111-38 Stockholm, both of Sweden

[21] Appl. No.: 189,832

[22] PCT Filed: Feb. 22, 1979

[86] PCT No.: PCT/SE79/00039

§ 371 Date: Oct. 23, 1979

§ 102(e) Date: Oct. 23, 1979

[87] PCT Pub. No.: WO79/00658

PCT Pub. Date: Sep. 6, 1979

[51] Int. Cl.[3] ..... F42B 13/42

[52] U.S. Cl. ..... 102/505; 102/340; 102/351; 102/357; 343/18 E

[58] Field of Search ..... 102/501, 505, 357, 340, 102/351, 221, 222, 278; 343/18 E, 18 B

[56] References Cited

U.S. PATENT DOCUMENTS

| | | | |
|---|---|---|---|
| 3,899,975 | 8/1975 | Laurence | 102/505 |
| 4,026,188 | 5/1977 | Woodruff et al. | 89/1.5 R |
| 4,031,828 | 6/1977 | Larson | 102/505 |
| 4,175,469 | 11/1979 | Ritland et al. | 102/505 |
| 4,222,306 | 9/1980 | Maury | 102/505 |
| 4,263,835 | 4/1981 | Dragonuk | 89/1.5 |

FOREIGN PATENT DOCUMENTS

| | | |
|---|---|---|
| 2638920 | 2/1978 | Fed. Rep. of Germany . |
| 382040 | 2/1976 | Sweden . |
| 1248867 | 10/1971 | United Kingdom . |

OTHER PUBLICATIONS

English translation of German patent app. OS 2530 057.
English translation of Swedish published patent application 76-01-570-0.
British Counterpart of German published patent application OS 1,961,642.

*Primary Examiner*—Harold Tudor
*Attorney, Agent, or Firm*—James R. Custin; James E. Nilles

[57] ABSTRACT

A projectile (1) containing particles of interference material is fired pneumatically from a launching tube (2). Compressed air, which is supplied to the launching tube and acts on the rear face of the projectile during firing, is conducted both to a loading chamber (19) wherein the air pressure is maintained even after the projectile has left the firing tube, and also via the loading chamber to an expansion chamber (20) in which, after a specific time-lag corresponding with a certain launch height on the trajectory of the projectile, an over-pressure builds up which causes the expansion of the chamber to be initiated with simultaneous expulsion of the interference material from the projectile. The compressed air may also be conducted to the chamber (10) in the projectile wherein the interference material is accommodated, tightly packed, in order to enhance the dispersion thereof.

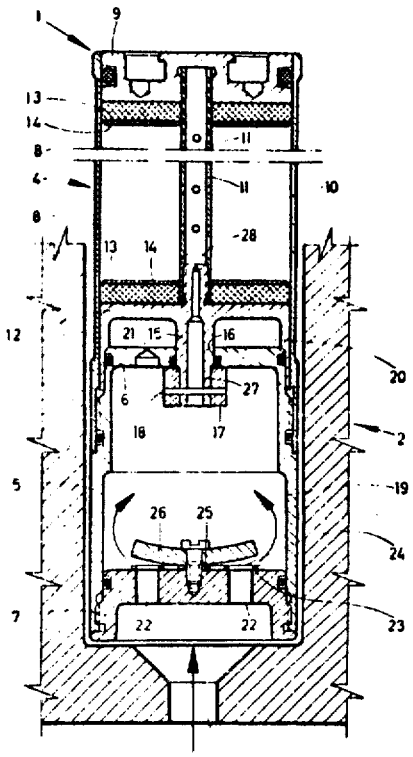

5 Claims, 4 Drawing Figures